US005955023A

United States Patent [19]

Ioffe et al.

[11] Patent Number: 5,955,023

[45] Date of Patent: Sep. 21, 1999

[54] METHOD OF FORMING COMPOSITE PARTICLE PRODUCTS

[75] Inventors: Lazar O. Ioffe, Brighton; Micail N. Raskin, Stoughton, both of Mass.

[73] Assignee: Callutech, LLC, Everett, Mass.

[21] Appl. No.: 08/800,875

[22] Filed: Feb. 14, 1997

Related U.S. Application Data

[63] Continuation-in-part of application No. 08/758,588, Nov. 27, 1996, abandoned.

[51] Int. Cl.[6] ..... B27N 3/04

[52] U.S. Cl. ..... 264/463; 264/37.13; 264/37.18; 264/109; 264/115; 264/122; 264/124

[58] Field of Search ..... 264/460, 463, 264/37.13, 37.18, 109, 122, 124, 115

[56] References Cited

U.S. PATENT DOCUMENTS

| | | | |
|---|---|---|---|
| 3,673,020 | 6/1972 | De Jaeger | 156/62.2 |
| 3,894,569 | 7/1975 | Huttunen | 144/327 |
| 3,981,338 | 9/1976 | Jones | 14/309 D |
| 3,986,268 | 10/1976 | Koppelman | 34/1 |
| 4,007,350 | 2/1977 | Gillet | 219/10.81 |
| 4,017,430 | 4/1977 | Briggs | 260/17.5 |
| 4,018,642 | 4/1977 | Pike et al. | 156/272 |
| 4,105,606 | 8/1978 | Forss et al. | 260/17.5 |
| 4,156,805 | 5/1979 | Gillet | 219/10.53 |
| 4,244,846 | 1/1981 | Edler | 260/17.3 |
| 4,287,140 | 9/1981 | Peters et al. | 264/23 |
| 4,332,589 | 6/1982 | Lin | 8/557 |
| 4,343,840 | 8/1982 | Edwards et al. | 427/351 |
| 4,358,418 | 11/1982 | Heggenstaller | 264/108 |
| 4,441,877 | 4/1984 | Pagnoni | 425/338 |
| 4,469,156 | 9/1984 | Norimoto et al. | 144/380 |
| 4,488,361 | 12/1984 | Lööf | 34/1 |
| 4,517,147 | 5/1985 | Taylor et al. | 264/83 |
| 4,672,006 | 6/1987 | McGraw | 428/528 |
| 4,726,881 | 2/1988 | Schultz | 162/109 |
| 4,797,157 | 1/1989 | Dilling et al. | 106/20 |
| 4,830,929 | 5/1989 | Ikeda et al. | 428/542.8 |
| 4,892,618 | 1/1990 | Simonson et al. | 162/16 |

(List continued on next page.)

FOREIGN PATENT DOCUMENTS

| | | |
|---|---|---|
| 0 460 235 A1 | 7/1991 | European Pat. Off. . |
| 0 536 795 A1 | 10/1992 | European Pat. Off. . |
| 0 612 595 A1 | 8/1994 | European Pat. Off. . |
| 19741153A1 | 3/1998 | Germany . |
| 63-112678 | 5/1988 | Japan . |
| 03097503 | 4/1991 | Japan . |
| 291789 | 5/1968 | U.S.S.R. . |
| 709851 | 6/1954 | United Kingdom . |
| WO 88/02417 | 4/1988 | WIPO . |
| WO93/02842 | 2/1993 | WIPO . |
| WO94/25273 | 11/1994 | WIPO . |
| WO94/29089 | 12/1994 | WIPO . |

OTHER PUBLICATIONS

Buchter, J. et al., "Rational wood compressing by Compwood™System" manuscript (Department of Wood and furniture at the Danish Technological Institute), Introduction, pp. 1–32 and two pages of illustrations (1993).

Tikhomolova, K.P. (Department of Chemistry, University of St. Petersburg, Russia), "General theoretical concepts" and "Practical application of electro–osmosis" (Chapters 1 and 4), *Electro–Osmosis,* pp. 1–35 and pp. 193–206 (Ellis Horwood Limited, 1993).

(List continued on next page.)

*Primary Examiner*—Mary Lynn Theisen

*Attorney, Agent, or Firm*—Lahive & Cockfield, LLP; Anthony A. Laurentano

[57] ABSTRACT

The present invention attains the foregoing and other objects of the invention by providing a method of forming a composite particle product from ligno-cellulosic material bonded together with water-insoluble lignin. The lignin has a relatively low molecular mass, e.g., less than 10,000 Daltons, and has a relatively high number of reactive functional groups. The lignin and material is then heated and compressed to promote bending and cross-linking between the lignin binder and the ligno-cellulosic material.

44 Claims, 2 Drawing Sheets

U.S. PATENT DOCUMENTS

| | | | |
|---|---|---|---|
| 4,933,125 | 6/1990 | Reiniger | 264/29.4 |
| 4,942,081 | 7/1990 | Reiniger | 428/218 |
| 4,966,650 | 10/1990 | DeLong et al. | 162/14 |
| 4,972,154 | 11/1990 | Bechtel et al. | 324/663 |
| 4,976,905 | 12/1990 | Brown | 264/115 |
| 4,994,138 | 2/1991 | Prihoda | 156/580 |
| 5,017,319 | 5/1991 | Shen | 264/124 |
| 5,026,808 | 6/1991 | Schroeder | 527/400 |
| 5,071,771 | 12/1991 | Barbour et al. | 436/153 |
| 5,075,402 | 12/1991 | Schmitt et al. | 527/400 |
| 5,139,861 | 8/1992 | Williams et al. | 428/288 |
| 5,154,968 | 10/1992 | DePetris et al. | 428/283 |
| 5,177,169 | 1/1993 | Schroeder | 527/400 |
| 5,190,088 | 3/1993 | Thomassen et al. | 144/361 |
| 5,196,212 | 3/1993 | Knoblach | 425/174.8 R |
| 5,202,403 | 4/1993 | Doering | 527/403 |
| 5,228,947 | 7/1993 | Churchland | 156/580.1 |
| 5,234,747 | 8/1993 | Walser et al. | 428/215 |
| 5,242,435 | 9/1993 | Murji et al. | 604/374 |
| 5,245,154 | 9/1993 | Sato et al. | 219/10.81 |
| 5,252,275 | 10/1993 | Sultze et al. | 264/119 |
| 5,360,631 | 11/1994 | Strauss | 427/154 |
| 5,367,040 | 11/1994 | Teodorczyk | 528/137 |
| 5,387,385 | 2/1995 | Murji et al. | 264/160 |
| 5,436,069 | 7/1995 | Winterowd et al. | 428/308.8 |

OTHER PUBLICATIONS

Sameshima, K., "Japanese Local Paper Mill Needs a Way to Survive; Kenaf is One of the Hopefuls" (6 pages).

METHOD OF FORMING COMPOSITE PARTICLE PRODUCTS

This application is a continuation-in-part application of U.S. Ser. No. 08/758,588, filed Nov. 27, 1996, now abandoned, entitled "WOOD WITH IMPROVED PERFORMANCE AND METHOD, APPARATUS, AND MATERIAL FOR TREATING WOOD," the teachings of which are hereby incorporated by reference.

BACKGROUND OF THE INVENTION

This invention relates generally to the formation of particle composite products, and more particularly to a method of forming particle composite products from ligno-cellulosic material. As used herein, the term ligno-cellulosic material is intended to include logs, lumber, wood particles, wood chips, wood flakes, wood wafers, wood fibers, wood veneer and other wood products and parts thereof, as well as other lignin and cellulose containing matter, such as woody plants, foliage, roots, shells, pot, nuts, husks, fibers, straw, vine, grass, bamboo, and reeds.

The ever increasing demand for wood and the rising costs associated therewith have driven the wood industry to develop products made of alternative materials, such as scrap or production based materials. One particular wood-based product is composite particle products that are formed from relatively small ligno-cellulosic material. Products based on these composite particle products that have been bonded together to form a comparatively homogeneous sheet by means of an adhesive have garnered considerably popularity in the building industry. The term "composite particle product" is intended to include those products made from the bonding together of relatively small ligno-cellulosic material, such as material having a size smaller than veneer sheets and preferably smaller than two inches, and is intended to include particleboard, flakeboard, oriented strand board (OSB), plywood, hardboard, softboard, chipboard and the like.

The manufacture of composite particle products are known in the art. Generally, the composite products are formed from ligno-cellulosic material fragments or pieces, such as wood chips, flakes, strands and fibers, that are bonded together via a suitable heat-hardenable thermosetting adhesive under selected pressure and temperature conditions to form the product. The ligno-cellulosic material used is generally manufactured from the residue of milling operations, such as planer shavings, sawdust, plywood trimmings, and the like. Milling residues may be further reduced to an appropriate or desired size in a hammermill operation.

If the size of the ligno-cellulosic material is such that it needs to be reduced further, it is generally conditioned in water prior to reduction in a flaking or chipping machine. The reduced material is known as furnish. The furnish is then dried to a substantially uniform moisture, usually ranging from between 3% and 6%, in known drying apparatus. The dried furnish is then screened to segregate selected particle sizes. For example, fine particles are used to form the exposed surface of the composite products to produce a smooth surface, or are used as fuel for the composite forming process.

The furnish is then introduced to a blender and the heat-hardenable thermosetting adhesive, such as urea-formaldehyde or phenol-formaldehyde, is added. These thermosetting resins typically require the application of heat and pressure to cure them. The furnish and adhesive is then deposited on a belt conveyor system in a loose mat form and is transported to a heat press reactor station, which heats and presses the mat to cure (harden) the adhesive resin. The heat press station is typically maintained at relatively low temperatures to avoid carbonizing the mat during curing. During this curing stage, the adhesive is thermally fused with the ligno-cellulosic material. The resultant formed composite particle product is then cooled and transported to a downstream finishing station where the product is embossed, finished and cut to any appropriate size. This product formation technique is well known in the art as disclosed in U.S. Pat. No. 4,933,125 of Reiniger, U.S. Pat. No. 4,517,147 of Taylor et al., U.S. Pat. No. 5,154,968 of DePetris et al., and U.S. Pat. No. 4,726,881 of Schultz. The predominant product produced from the foregoing system is composite sheets that are used as underflooring or in other building applications.

A drawback of the foregoing composite product forming systems is that the resultant sheet product is sensitive to moisture. This sensitivity can be attributed on the one hand to the type of adhesive used, and on the other hand to the ligno-cellulosic material. Specifically, the product absorbs moisture, which causes the ligno-cellulosic material to expand, overcoming the binding forces of the hardened adhesive. This results in splitting and cracking of the composite product.

The conventional systems further employ either aminoresins, such as urea-formaldehyde, or phenolic resins, such as phenol-formaldehyde as thermosetting adhesives. Aminoresins are polymeric products of the reaction of an aldehyde with compounds as thermosetting adhesives containing amino groups, particularly urea and melamine. In nearly all aminoresins, the aldehyde component is formaldehyde and by far the dominant aminoresin is urea-formaldehyde. A major disadvantage of aminoresins are that they are not completely water-resistant, and consequently are known to delaminate during use. Another drawback is that they are known to leach formaldehyde during their slow water hydrolysis.

Phenolic resins are polymeric products of the reaction between an aldehyde, a compound containing a phenolic hydroxyl group. The phenolic component is oftentimes phenol, but may also be cresol, resorcinol, or catechal. Formaldehyde is the most common aldehyde component although others such as furfural are occasionally used. The most common phenolic-type resin is phenol-formaldehyde resin. Phenol and the other phenolic substances are considerably more expensive than urea, but maintain their seam lines in the presence of moisture.

A drawback of the foregoing resins are that they are petroleum derived compounds, and thus are expensive and subject to the seasonal fluctuations in petroleum prices. Cost-wise these resins comprise a substantial portion of the overall system cost. Hence, it would be advantageous to employ a less expensive, non-petrochemical phenolic adhesive material. Another drawback of use of these resins is that formaldehyde is toxic, and thus concerns regarding outgassing or leakage of formaldehyde over time is of the utmost concern.

In an effort to overcome the foregoing drawbacks, the art began to employ preprocessed lignin in combination with one of the foregoing resins to help reduce the cost of the overall process. Lignin, as it occurs in all woody plants, is a three-dimensional macromolecule consisting of rather hydrophobic phenylpropane units. Commercial lignin is generally available as a by-product of the pulping process during the manufacture of paper. For example, lignosulfonate is obtained from the sulfite pulping process in which wood is cooked with sulfite in a liquor bath at elevated temperatures and at a selected pH level. In this process, the lignin is rendered water-soluble. This lignin component can then later be removed from the spent sulfite liquor.

Conventional techniques for modifying or preprocessing lignin into a water-soluble product for use as a binder in various wood processes exist. One prior art technique for solubilizing lignin is the methylolation of lignin, e.g., sulfite lignin. For example, as described in U.S. Pat. No. 4,332,589 of Lin, lignin is methylolated by treating lignin with formaldehyde under alkaline conditions at a temperature between about 60° C. and about 90° C. The resultant lignin is then acidified to a pH below 7 and heated to a higher elevated temperature. This technique for solubilizing sulfite lignin is further set forth in U.S. Pat. No. 4,244,840 of Edler and in U.S. Pat. No. 5,075,402 of Schmitt et al.

The methylolation of kraft lignin was also described in U.S. Pat. No. 5,202,403 of Doering. Doering describes the formation of a lignin modified phenol-formaldehyde adhesive compound formed by reacting phenol with formaldehyde to form a precursor resin in the presence of an alkaline material, such as sodium hydroxide. The resin is then heated to further polymerize the reactants, and then a lignin source, such as kraft lignin, is added in a controlled manner. The ligno-resin formed from this process can then be used in wood preparation processes as an adhesive.

Another prior art technique for preprocessing lignin includes the demethylation of lignin. This treatment increases the amount of aromatic hydroxilic groups in lignin, rendering the lignin water-soluble. This technique is described in U.S. Pat. No. 5,177,169 of Schroeder.

Simonson et al., U.S. Pat. No. 4,892,618, describes a method of forming adhesive bonded wood products using lignin containing compounds. In alkaline solution Kraft lignin is water-soluble and is used to impregnate the material. The solubilized ligni is then converted back to its water-insoluble form while resident within the material upon reaction with an aluminum salt, such as sulfate or chloride. According to the described technique, kraft lignin is reacted with an alkaline material (NaOH), and is then precipitated and purified. Wood is then impregnated with the solubilized lignin compound. A conventional adhesive, such as melamine-urea-formaldehyde adhesive, was used to adhere the wood pieces.

A significant disadvantage of the foregoing techniques is that they require time-consuming and cost intensive preprocessing and transformation of lignin into a water-soluble form for use in adhesive compounds. This processing adds substantially to production costs since lignin is converted from a naturally water-insoluble form into a water-soluble form.

Due to the foregoing and other shortcomings of the foregoing prior art technologies, an object of this invention is to provide a novel system and method for employing lignin as an adhesive to bond together ligno-cellulosic material.

Another object of the invention is to provide a cost effective system and method for forming composite particle products employing lignin as a binder.

Still another object of the invention is to provide a method for forming a composite product by impregnating wood with lignin.

Yet another object of the invention is to provide a relatively inexpensive system and method for producing composite particle products.

Other general and more specific objects of the invention will in part be obvious and will in part appear from the drawings and description which follow.

SUMMARY OF THE INVENTION

The present invention attains the foregoing and other objects of the invention by providing a method of forming a composite particle product from ligno-cellulosic material bonded together with water-insoluble lignin. The lignin has a relatively low molecular mass, e.g., less than 10,000 Daltons, and has a relatively high number of reactive functional groups. The lignin and material is then heated and compressed to promote bending and cross-linking between the lignin binder and the ligno-cellulosic material.

According to one practice, the ligno-cellulosic material is impregnated with water-insoluble lignin dissolved in an organic solvent or a mixture with water. The impregnated material is then heated and compressed to form the composite product. The use of water-insoluble lignin eliminates the need for conventional costly and time-consuming preprocessing of lignin, which includes the solubilizing of the lignin by methylolation, demethylation and carboxy methylation techniques.

According to another practice, the ligno-cellulosic material is mixed with dry, powdered water-insoluble lignin. The mixture is then heated and compressed to form the composite product. According to still another practice, the ligno-cellulosic material is impregnated with water-insoluble lignin dissolved in an organic solvent or a mixture of the organic solvent and water. The impregnated material is then optionally mixed with dry or aqueous water-insoluble lignin. The mixture is then heated and compressed to form the composite product.

The method for forming a composite particle product of the present invention includes adding water-insoluble lignin to the ligno-cellulosic material to form a lignin bonding mixture. The mixture is then formed into the composite particle product.

According to one aspect, the product is formed by compressing the lignin bonding mixture, and heating the mixture to a selected elevated temperature to promote bonding between the water-insoluble lignin and the ligno-cellulosic material. The heating portion of the process promotes either bonding or cross-linking between the ligno-cellulosic material and the water-insoluble lignin. According to one optional practice, the lignin bonding mixture is heated with electromagnetic energy having a frequency in the range between about 2 MHz and about 2000 MHz, such that temperatures between about 100° C. and about 240° C. are attained. The mixture can be heated for a time between about 1 second and about 60 seconds per millimeter of thickness of the particle product thickness.

According to another aspect, the product is formed by subjecting the lignin bonding mixture to one of an elevated temperature and an elevated pressure to promote bonding between the water-insoluble lignin and the ligno-cellulosic material components to form the composite particle product.

According to another aspect, the water-insoluble lignin has a relatively low molecular mass, e.g., having a mass less than or equal to about 10,000 Daltons.

According to another practice, the lignin can be highly reactive lignin having reactive functional groups selected from the group consisting of phenolic groups, alcohol groups, carbonyl groups, carboxyl groups, and double bonded propyl chains.

According to still another aspect, the lignin can be dried to a utility level of dryness, and according to one practice, to a moisture content of about 30% or less.

According to another aspect, additional compounds can be used to promote the bonding between the water-insoluble lignin and the ligno-cellulosic material, such as furfural, formaldehyde, glyoxal, urea-fornaldehyde resins, phenol-formaldehyde resins, melamino-formaldehyde resins, phenols, amine phenols, polyacids, polyisocyanates, polyamides, natural and synthetic latexes, organosilanes, and mixtures and derivatives thereof.

According to another embodiment of the invention, the composite product is formed by impregnating the ligno-cellulosic material with water-insoluble lignin, and then forming the composite particle product from the impregnated ligno-cellulosic material.

According to one aspect, the water-insoluble lignin is dissolved in an organic solvent, such as alcohol.

According to another aspect, the ligno-cellulosic material is dried prior to impregnation to a moisture content of about 30% or less.

According to another aspect, the product is formed by compressing and heating the impregnated material to a selected elevated temperature to promote bonding between the water-insoluble lignin and the ligno-cellulosic material. The heating portion of the process promotes either bonding or cross-linking between the ligno-cellulosic material and the water-insoluble lignin. According to one optional practice, the lignin bonding mixture is heated with electromagnetic energy to attain temperatures between about 100° C. and about 240° C.

According to another aspect, the water-insoluble lignin has a relatively low molecular mass, e.g., having a mass less than or equal to about 10,000 Daltons. According to another practice, the lignin can be highly reactive lignin having reactive functional groups selected from the group consisting of phenolic groups, alcohol groups, carbonyl groups, carboxyl groups, and double bonded propyl chains.

According to another aspect, additional water-insoluble lignin is added to an outer surface of the impregnated ligno-cellulosic material to further promote the bonding between the lignin and the material.

The present invention further contemplates products formed from one or more steps of the above-described processes.

Other general and more specific objects of the invention will in part be obvious and will in part be evident from the drawings and description which follow.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

DESCRIPTION OF ILLUSTRATED EMBODIMENTS

Figure 1:
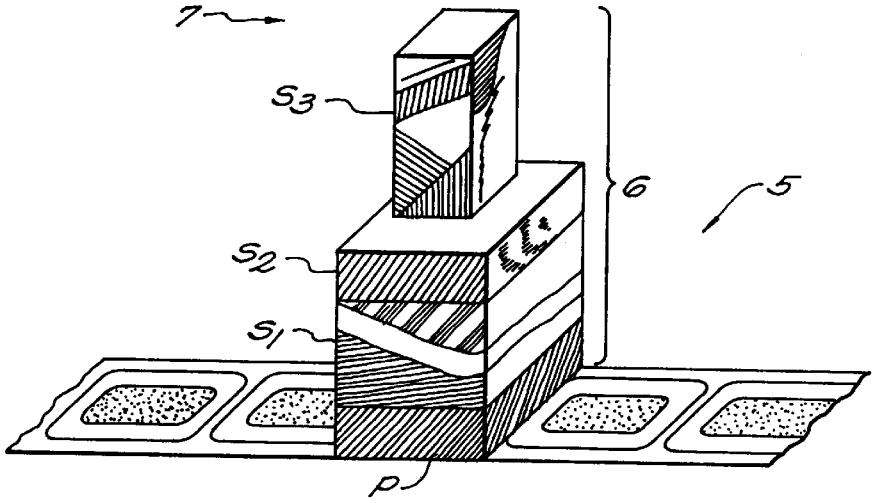
FIG. 1 is an axonometric view, partially broken away, of an exemplary wood cell of Scotch Pine.

FIG. 1 is an axonometric view partially broken away of an exemplary wood cell 5 such as the wood cell of Scotch Pine. For the sake of simplicity, the term wood will be used herein, but the teachings of the invention can apply to any ligno-cellulosic material. Wood is an extremely versatile material with a wide range of physical and mechanical properties among the many species of wood. The primary structural building block of wood is the tracheid or fiber cell 5. These cells vary in size between about 16 microns and about 42 microns in diameter and can range in various lengths, such as between about 870 microns and about 4,000 microns. Hence, a cubic centimeter of wood contains more than 1.5 million wood cells. When packed together, these wood cells form a strong composite material. Each individual wood cell 5 is even more structurally advanced because it is actually composed of a multilayered, filament-reinforced, cell structure rather than just a homogenous-walled, non-reinforced strand.

Wood is typically composed of a three-dimensional polymeric composite made of primarily cellulose, hemi-cellulose and lignin. The wood cell 5 structure is generally composed of cell walls 6 having an interior volume 7 where there was previously a cell nucleus when the cell was alive. The cell wall 6 of the illustrated wood cell 5 has four distinct cell wall layers, conventionally referred to as the primary (P), $S_1$, $S_2$, and $S_3$ layers. The P and $S_1$ layers are outer layers and are composed mainly of lignin, with smaller amounts of cellulose and hemi-cellullose. The $S_2$ layer is a relatively thick central wall, e.g., intermediate between the $S_1$ and $S_3$ layers, and is composed mainly of cellulose, and the $S_3$ layer 10 is an inner layer composed mostly of hemi-cellulose.

The cellulose and hemi-cellulose are linear polysaccharides (i.e., hydrophilic multi-sugars), and lignin is an amorphous phenolic compound. Cellulose typically forms long unbranched chains, and hemi-cellulose forms short branched chains. Lignin typically encrusts and stiffens these two polymers. The wall structures are responsible for most physical and chemical properties of wood. For example, for nominal soft wood, a typical cell length is about 3 mm, and a typical cell diameter is about 0.03 mm. For a nominal hard wood, a nominal cell length is between about 0.8 mm and about 1.5 mm, and the cell diameter is about 0.01 mm.

Wood typically contains between about 20% and 30% lignin, e.g., naturally occurring lignin. About 20% of this lignin exists in the intercellular regions of the wood, and the bulk of the remainder is located in the secondary cell wall dispersed among the polysaccharides, e.g., cellulose and hemi-cellulose. Lignin is a three-dimensional, highly branched phenolic-like (phenol propane) polymer of amorphous structure possessing a variety of functional groups that provide potential reactive sites for chemical and biological modifications of the polymer. Lignin is substantially found as a by-product of wood processing wastes, for example, waste produced during the pulping process of paper mills. For example, lignin is generally separated from the other wood constituents during chemical pulping processing. As such, lignin is generally not produced as a product in and of itself. The lignin which is separated from the cellulose and hemi-cellulose portions of the wood during the pulping process is typically removed from the pulping liquor, by known techniques. As a waste product in pulp mills, the lignin is generally used as fuel for mill energy, as well as for other purposes, such as use as dispersants, oil-well-drilling muds, a covering for the pelletizing of selected materials, such as animal feed, molding stabilizers, concrete grinding additives, and adhesive extenders. Consequently, lignin is a renewable, abundant and relatively inexpensive material.

The present invention provides for a method of forming composite particle products from ligno-cellulosic material utilizing process lignin, e.g., added lignin, as an adhesive binder. More specifically, the present invention employs water-insoluble lignin as an adhesive binder to glue together, via cross-links and bonds, the ligno-cellulosic material. The term "water-insoluble" lignin is intended to include naturally occurring and non-naturally occurring lignin that is substantially insoluble in water at neutral or acidic conditions and/or at room temperature, and which is preferably soluble in an alkaline solution or environment. The direct addition of water-insoluble lignin to the wood, without pre-processing the lignin to transform it into a soluble form prior to mixing with the wood provides for significant cost savings.

Descriptions of lignin suitable for use as an adhesive are provided herein with respect to the types of lignin currently available, since lignin is in and of itself not available according to catalog specifications from conventional reagent suppliers. However, those skilled in the art will readily understand the various forms of lignin, and thus how to make and use the present invention. Hence, the term "lignin" as used herein is intended to include all available forms of lignin, either naturally occurring or formed from conventional processes (e.g., non-naturally occurring), such as pulping processings, examples of which include sulfite lignin (ligno sulfonate), kraft lignin, organosolv lignin (such as ALCELL® lignin), steam-exploded lignin, and biomass pyrolysis lignin. As is known, lignin is generally neither hygroscopic nor water-soluble. The lignin of the present invention preferably has a relatively high reactivity, e.g., has a number of reactive functional groups, such as phenolic groups R—OH where R is a covalently bonded aromatic ring, alcohol groups R'—OH where R' is a covalently bonded hydrocarbon group, carbonyl and carboxyl groups, propyl chains which include double bonds, e.g., —CH=CH—$CH_3$, as well as free or unsubstituted positions available in the aromatic rings. As used herein, the term "relatively high" is intended to include lignin that is capable of reacting with adjacent wood constituents or with adjacent lignin molecules, and can include one or more phenolic groups per phenol propane units. According to another practice, the lignin has a relatively low molecular mass (e.g., weight), such as below 10,000 Daltons, preferably less than 5,000 Daltons, and most preferably less than 3,000 Daltons.

The relatively high reactivity lignin suitable for use with the present invention is able to form condensed polymer lignin chemically connected, through bonding and cross-linking, to the ligno-cellulosic material which constitute the composite particle product. The reactive functional groups of lignin provides for both bonding and linking of the process lignin with the constituent components of the ligno-cellulosic material, e.g., cellulose and/or hemi-cellulose. The bonding and linking of the process lignin to the ligno-cellulosic material allows the ligno-cellulosic material to be formed into composite particle products.

The double bonds formed in the propyl chain of lignin can be further provided by acrylic acid, which can be used to promote bonding of the process lignin with the material. Chemical reaction of the process lignin with the wood can also be promoted by the addition of monomer, oligomer or bonding substances such as furfural, formaldehyde, glyoxal, urea-formaldehyde resins, phenol-formaldehyde resins, melamino-formaldehyde resins, phenols, amine phenols, polyacids, polyisocyanates, polyamides, natural and synthetic latexes, organosilanes, and mixtures and derivatives thereof. Those of ordinary skill will also be able to determine from the teachings herein other suitable substances that promote bonding between the process lignin and the wood.

Figure 2:
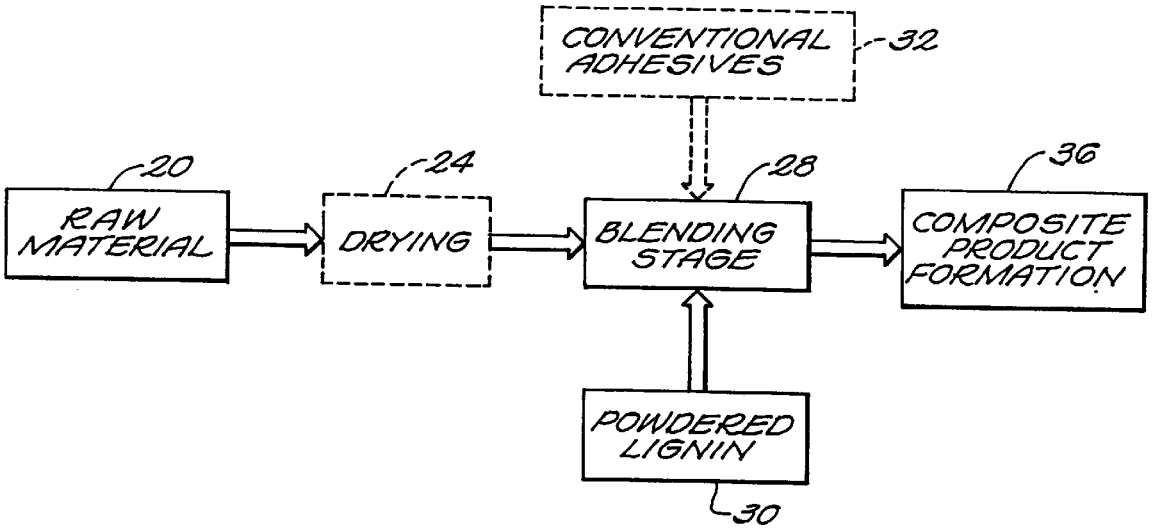
FIG. 2 is a schematic block diagram of one method of forming a composite particle product employing water-insoluble lignin according to the teachings of the present invention.

FIG. 2 illustrates one method of forming composite particle products according to the teachings of the present invention. Raw material 20 is provided and forms part of a mixture which includes a suitable binding adhesive, as described in further detail below. The raw material 20 and the suitable adhesive are combined or mixed together in a blender at a blending stage 28. The raw material 20, which according to the present invention is ligno-cellulosic material, can be dried prior to introduction to the blending stage 28, illustrated in phantom by drying stage 24, to a suitable process compatible moisture level by known drying techniques, if necessary. Conventional drying techniques include kiln drying, steam drying, radio frequency drying, and microwave drying, all of which are known.

According to one practice, the drying stage 24 can include a high frequency drying chamber, such as that shown and described in U.S. Ser. No. 08/577,049, filed Dec. 22, 1995, entitled "Method and Apparatus for Densifying Ligno—Cellulosic Material", the teachings of which are herein incorporated by reference. The drying stage 24 prepares the wood for further treatment by drying the wood and, according to another practice, homogenizing the moisture content in the wood. This homogenization process is effected as follows. The ligno-cellulosic material typically contains large pockets of moisture that are randomly dispersed throughout the structure of the ligno-cellulosic material, as well as other smaller moisture pockets. The size and number of moisture pockets is a function of the total moisture content of the material, the ambient pressure and temperature, and other environmental factors. Typically, the moisture pockets are located towards the center of the material, since the material dries from the outer portion towards the center portion of the work piece. When the ligno-cellulosic material is exposed to a high frequency electric field, the field penetrates deep into the wood and transfers energy into the internal or interior portions of wood, and specifically to the water contained in the moisture pockets.

The electric field absorbed by the material, and particularly by the water, causes molecules, and particularly those with a relatively high electric dipole moment, such as water molecules, to vibrate and to rotate back and forth as a result of the torque placed thereon by the field. The mechanical energy created by this dipole rotation and/or molecular vibration is transferred to the surrounding wood structure as internal energy or heat. Adjacent wood structure containing lower levels of moisture absorb less energy and thus generate less heat. The difference in heat absorption between adjacent locations effectively creates a thermal gradient within the wood, causing heat from high temperature areas to diffuse to lower temperature areas.

The thermal gradient created by the absorbed high frequency energy also causes water to migrate out of the high moisture regions and into surrounding regions containing lower moisture (moisture gradient). The thermal and moisture gradients can further be utilized to evenly dry the ligno-cellulosic material.

The moisture content of the ligno-cellulosic material is defined as the weight of water contained therein given as a percentage of oven dry weight. According to the present invention, the suitable process compatible moisture levels are less than about 30%, and preferably less than about 20%. Hence, if the raw material supplied by the stage 20 is not sufficiently dry, then it is further dried to within the foregoing process compatible moisture ranges by any of the above-described techniques.

In the illustrated blending stage 28, the dried ligno-cellulosic material is combined or mixed with water-insoluble process lignin, either powdered or in aqueous form, from a lignin source 30. The water-insoluble lignin and ligno-cellulosic material mixture is then formed into a composite particle product in the formation stage 36, as described below. The amount of lignin 30 added during the blending stage 28 can be varied over a wide range, and depends upon the type of lignin used, the number of reactive functional groups of the lignin, the fabrication conditions of the composite material including the temperature, pressure, and duration of pressing and heating during the product forming stage, as well as the specifications of the final composite product. All these factors combine during the product forming stage 36 to determine the amount of lignin which can be added during the blending stage to function as a suitable adhesive to bind together the ligno-cellulosic material. Those of ordinary skill, knowing the above-referenced factors, can determine an appropriate amount of water-insoluble lignin to be used during the blending stage. According to a preferred practice, the lignin provided by the lignin source 30 does not amount to less than about 2%–3% of the dry oven weight of the ligno-cellulosic material provided to form the composite particle product, since the resultant product would be of very low strength. There is generally no upper limit with regard to the amount of lignin which can be provided during the blending stage 28, and a practical upper limit could be upwards to about 40%, or even higher.

Those of ordinary skill will readily recognize that water-soluble lignin can be combined with the water-insoluble lignin 30 for use as the binding adhesive of the present invention. The relative amount of the solubilized lignin added to the water-insoluble lignin is immaterial provided that the water-insoluble lignin 30 aids in or primarily functions as the adhesive for the composite particle product.

A significant feature of the present invention is that the process lignin 30 is a water-insoluble process lignin. Consequently, the composite particle product formed according to the teachings of the present invention utilizes water-insoluble lignin to provide for a highly cost-effective approach to forming the products since it does not require lignin pre-processing (methylolation or demethylolation) prior to or contemporaneously with addition of the ligno-cellulosic material.

The composite particle product formed during the forming stage 36 includes the heating and compressing of the blended or mixed lignin and ligno-cellulosic material, according to known techniques. For example, the lignin/ligno-cellulosic material mixture can be separated into suitable mats on a transportation assembly, e.g., a conveyor belt, to form a mat of prescribed size and thickness. The mat is then transferred to a heat press station having a heating and compressing assembly, where the mat is exposed to elevated temperatures and pressures. According to the present invention, the mat can be heated to temperatures in the range between about 100° C. and about 240° C. The temperatures to which the mat is exposed plasticize the added process lignin 30, as well as activate the diffusion of lignin bound within the cell walls of the ligno-cellulosic material. The blended mixture is exposed to these elevated temperatures for a time that is dependent upon the thickness and size of the mat, the type of lignin and ligno-cellulosic material, and can range between about 1 sec to about 1 min per millimeter of composite thickness.

Lignin at appropriate temperatures diffuse and exhibit increased mobility and tackiness. This refers to the process lignin and to the lignin constituent of the ligno-cellulosic material. When disposed in this plasticized state, the lignin is inclined to autoadhesion, e.g., bonding to adjacent lignin components. It is believed that bonding between lignin units is, at least in part, the result of free radical polymerization of lignin monomers, e.g., free radical polymerization of vinyl functionalities, to form new covalent bonds. Analogous free radical polymerization processes are well known in the art, e.g., in the polymerization of styrene to form polystyrene. When wood is treated according to the methods of the invention, the formation of free radicals in the wood has been detected by electron paramagnetic resonance (EPR) techniques. The skilled artisan will appreciate that other modes of bond formation also occur. It is believed that bonding of adjacent lignin components results in a relatively strong and stable composite particle product, as a result of the formation of cross-links between adjacent lignin-lignin components and/or ligno-cellulosic material that stabilize the structure of the material to form a stable product.

It is believed that the lignin components do not bind together, e.g., become covalently bonded, until the wood attains a selected temperature within the same range of temperatures as defined above. Consequently, heating the process lignin and ligno-cellulosic material to within this range results in softening of the lignin, as well as bonding between adjacent lignin components. The added water-insoluble process lignin thus functions as an adhesive to bind the lignin and ligno-cellulosic material.

The mat is also exposed to compressive forces applied to the mat to compress the heated lignin and ligno-cellulosic material mixture to form the composite particle product. The compressive forces applied to the heated mat are preferably within the range between about 70 psi and about 1400 psi. The heating and compressing of the lignin and ligno-cellulosic material leads to the formation of cross-linking bonds between the macromolecules of the added process lignin and the ligno-cellulosic material, as well as between molecules of adjacent ligno-cellulosic material.

According to another practice, a conventional heat-hardenable adhesive can be supplied, along with the water-insoluble lignin 30, during the blending stage from an adhesive source 32. The conventional adhesives suitable for use as a binder in the formation of composite particle products are known in the art, and can include furfural, formaldehyde, glyoxal, phenols, urea-formaldehyde resins, phenol-formaldehyde resins, melamino-formaldehyde resins, polyisocyanates, polyamides, polyamines, polyacids, natural and synthetic latexes, siliceous organic substances and mixtures and derivatives thereof. The conventional adhesives are combined with the water-insoluble process lignin 30 to form a multi-adhesive mixture that binds together the ligno-cellulosic material to form the composite particle product. The amounts of the conventional adhesive supplied by the adhesive source 32 can vary, and generally are cost driven, since these adhesives are expensive and generally toxic compared to the process lignin. Those of ordinary skill will also recognize that water-soluble lignin can also be added to the adhesive mixture, and such a mixture is deemed within the scope of the present invention.

Figure 3:
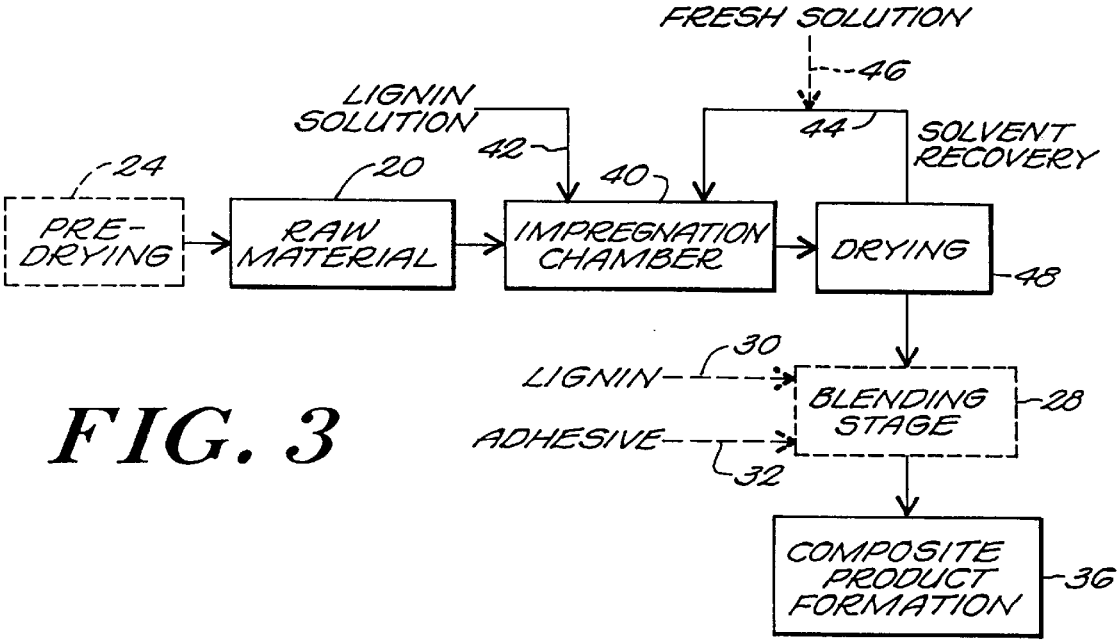
FIG. 3 is a schematic block diagram of another method of forming a composite particle product employing water-insoluble lignin according to the teachings of the present invention.

FIG. 3 illustrates another method for forming a composite particle product according to the teachings of the present invention. The illustrated formation system 21 includes some of the same stages as that illustrated in FIG. 2, and thus are designated with like reference numerals. Specifically, the raw material includes the ligno-cellulosic material, and the pre-drying stage 24 dries the ligno-cellulose material to a selected process compatible or utility moisture level, which is about 30%, and preferably is less than about 20%. The raw material is then introduced to an impregnation chamber system 40, such as that shown in FIGS. 4–6, and particularly in FIG. 4.

Figure 4:
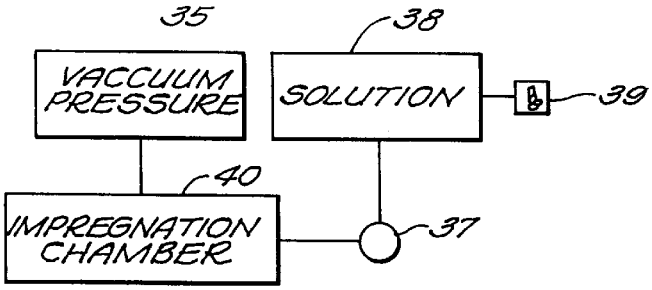
FIG. 4 is a schematic block diagram of the impregnation stage of the method of forming the composite particle product of FIG. 3.

With reference to FIGS. 3 and 4, the impregnation chamber 40 is coupled to a fluid source 38 which holds a suitable reagent solution. The fluid source 38 preferably includes structure for heating the reagent, e.g., a resistive heater, and a temperature control 39 for controlling the temperature thereof. The reagent solution can be heated to between about 40° C. and about 120° C. for improved penetration of the ligno-cellulosic material. The reagent solution can be drawn into the impregnation chamber 40, for example, by pressure applied by a vacuum pressure source 35 if it is desired to maintain a vacuum pressure therein. Alternatively, a pump 37 can be provided to pump the reagent solution into the impregnation chamber 40. For substantially complete cross-sectional impregnation, the electro-osmosis module, illustrated in FIG. 5, can be incorporated into the impregnation chamber 40, the operation of which is described below. The function and operation of the heating structure of the fluid source and the temperature and pressure controls are well known in the art and need not be described further herein.

The reagent solution can include a solution of water-insoluble, highly reactive process lignin, as described above, which is dissolved in a selected solution, such as an organic solvent. The generally water-insoluble lignin dissolved in the solution is then transferred or pumped into the impregnation chamber for subsequent impregnation of the ligno-cellulosic material. Solutions or solvents suitable for use in the present invention include organic solvents capable of dissolving the process lignin of the present invention. Examples of organic solvents suitable for use as a dissolving agent are polar organic solvents, and can include alcohols, ketones, esters, and derivatives and mixtures thereof, and other suitable polar solvents, such as dimethylformamide, dimethylsulfoxide, and tetrahydrofuran, that the skilled artisan would select according to the teachings of the present invention knowing the type of lignin and solvent and the relative proportions thereof. Such solvents provide for reliable dilution of the process lignin. According to one practice, an organic solvent is a volatile organic solvent, e.g., a solvent which can be removed by evaporation or distillation.

The organic solvents may also be mixed with water, which tends to swell the pores of the ligno-cellulosic material to further absorb the lignin solution. In preferred optional embodiments, the organic solvent is miscible with water when mixed or has substantial solubility in water, or vice versa. One preferred type of solvent is an alcohol, such as ethanol and methanol. A wide range of alcohol to water ratios can be utilized, and it may even be desirable to dilute the alcohol with water to reduce solvent cost. Increasing water levels may, however, result in decreased efficacy. Efficacy of solvents miscible with water may be achieved at solvent concentrations of 99.9% down to about 0.1% by weight. It is preferred that an alcohol-water solvent should be between about 30% and about 96% alcohol by weight. Alcohol is an attractive solvent in that it is clean and non-polluting, and is relatively easy to recover through distillation. Other organic solvents that are miscible with water can also be used.

The amount of lignin dissolved in the organic solvent can vary over a wide range. A minimum amount of lignin is that amount necessary to impregnate the ligno-cellulosic material for use as a binder, and depends upon the ability of the solvent to dissolve the lignin. According to one practice, the amount of lignin dissolved in the solution is in the range between about 0.1% and about 75%, is preferably in the range between about 0.1% and about 50%, and most preferably is between about 10% and about 40%. The present invention can achieve concentrations of lignin in the solution at the upper levels if the solution is heated (e.g., using the heating structure provided in the the fluid source 38) to relatively high temperatures, such as to about 170° C., or if the lignin is dissolved in an alkaline solution under relatively high pressure, such as at about 150 psi.

In another embodiment, the raw material when situated within the chamber 40 can have lignin added thereto by lignin source 42. The lignin can either be powdered or aqueous, and can be dissolved in the solvent supplied by the fluid source 38.

To determine whether the ligno-cellulosic material within the chamber 40 has been sufficiently impregnated with the lignin solution, selected properties of the impregnated ligno-cellulosic material can be measured by known techniques. Specific forms of impregnation include impregnation by vapor in the impregnation chamber 40. As shown in FIG. 4, the pressure control 35 draws a vacuum in the impregnation chamber 40 to attain a selected elevated vacuum level, such as 28 in Hg. A vacuum environment permits air to escape from the wood cells prior to impregnation with the lignin solution. Impregnation can be achieved at selected high pressures, such as pressures of about 10 $kg/m^2$, although higher pressures can also be used. Those of ordinary skill will readily recognize that the temperatures and times of impregnation can be varied, and the efficacy of each can be measured according to known wood performance tests.

Figure 5:
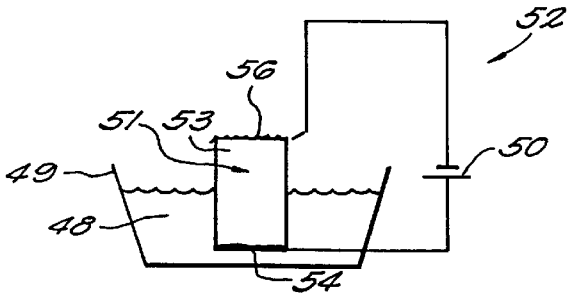
FIG. 5 is a cross-sectional view of an electro-osmosis system for impregnating ligno-cellulosic material suitable for use with the method of FIG. 3.

An additional form of impregnation suitable for achieving cross-sectional impregnation of the ligno-cellulosic material with a lignin solution is by electro-osmosis, which is shown in FIG. 5. The illustrated electro-osmosis unit 52 can be placed within the impregnation chamber 40. According to one practice, a dc power source 50 applies a potential across the ligno-cellulosic material 51 that is placed within a lignin solution 48 contained in a housing or tub 49. A first electrode 54 is placed within the tub 49, and a second selected electrode 56 contacts an upper end of the material 51. It is preferred in order to ensure contact with substantially an entire cross-section of the upper end 53 of the ligno-cellulosic material 51 that the electrode 56 be a wire gauze electrode. The dc source 50 generates a positive potential across electrode 54 and a negative potential across electrode 56. The illustrated electro-osmotic unit 52 reduces the need for drying the ligno-cellulosic material to the same degree necessary prior to impregnation of the material with the lignin solution since the unit 52 draws moisture out of the ligno-cellulosic material 51 and replaces it with the lignin solution. In this embodiment, the step of drying the wood to a utility moisture level can comprise simply using grain wood. It is, however, desirable to reduce wood moisture to below 30 percent prior to electro-osmosis.

The water-insoluble process lignin contained in the lignin solution 42 and the aforementioned process lignin 30 is preferably relatively low molecular weight lignin having a molecular mass less than 10,000 Daltons, preferably less than 3,000 Daltons, most preferably less than 3,000 Daltons, and preferably contains a relatively high content of highly reactive functional groups. Those of ordinary skill recognize that the presence of high molecular weight lignin impedes the dissolving of the lignin within the organic solvent, as well as prevents relatively easy diffusion of the low molecular lignin within the cell walls of the ligno-cellulosic material by occluding the pores of the wood cell 5.

Those of ordinary skill will also realize that the total quantity of lignin which can be impregnated into the ligno-cellulosic material is limited by the total pore volume of the material. Hence, if the concentration of lignin in the solution is about 10 percent, and the total pore volume in the ligno-cellulosic material is about 60 percent, then the quantity of lignin present within the solution after impregnating the ligno-cellulosic material can reach up to about 6 percent of the total volume, and between about 4% and 4.5% by weight (taking into consideration the higher density of the ligno-cellulosic material). This amount of impregnated lignin is substantially less than the lignin used during the particle product formation stage of FIG. 2. The rest of the lignin contained within the lignin solution 42 generally coats the outer surfaces of the ligno-cellulosic material, which upon heating in the drying stage 48 bonds together adjacent material.

Referring again to FIG. 3, the impregnated ligno-cellulosic material is then removed from the impregnation chamber 40 and transported to a drying stage 48. The illustrated drying stage 48, which can comprise any conventional drying unit (similar to drying stage 24, FIG. 2) dries the wood to a utility level of dryness. As used herein, this utility level of dryness refers to a level which is suitable for the ligno-cellulosic material to be used in the next step in processing for its intended purpose. This level would be readily determinable by the skilled artisan when considering the type of ligno-cellulosic material, the type of lignin, the amount of energy consumed, and the intended use of the composite product. For example, typical pine lumber for use in construction is dried to a utility level of 19%, and wood for use in furniture is commonly dried to a utility level of 6%. As those of ordinary skill will recognize, a wide range of utility dryness levels are suitable for practice in accordance with the present invention. The maximum preferred utility level is about 10% moisture. Removal of moisture from the ligno-cellulosic material permits improved entry of lignin into the wood cells 5, FIG. 1.

According to one practice, the heating/drying unit of FIG. 5 can employ a high frequency generator to electromagnetically dry, in a shielded enclosure 62, the impregnated ligno-cellulosic material 61. As illustrated, the ligno-cellulosic material 61 can be placed within the enclosure 62 and surrounded by an energizable coil 65. This unit 65 is connected to and supplied by a radio frequency (RF) source 68. The high frequency energy generated by the source 68 dries the material 61, and in particular dries the core of the material, as described above. This is an important feature for the present cross-sectional impregnation process of the present invention. It has been found that radio frequency energy provided at a field strength of between about 20 kV/m and about 200 kV/m can substitute for kiln heat treatment performed between about 120° C. and about 240° C.

In another embodiment, the drying stage 48 can utilize conventional kiln drying techniques for heating the impregnated ligno-cellulosic material to temperatures between about 130° C. and about 170° C., for between about 0.1 hrs and about 3 hrs. Efficacy can also be realized by electromagnetically heating the material to between about 120° C. and about 240° C. for between about 2 minutes and about 2 hours. Those of ordinary skill will recognize that a combination of the electromagnetic heating and kiln drying heating can also be used.

Referring again to FIG. 3, the organic solvent used during the impregnation process can be recovered through a solvent recovery system 44 during the drying stage 48. The solvent recovery network 44 can be coupled with the impregnation chamber 40 to form a solvent recirculation loop, such that solvent recovered during the drying process is used during the impregnation stage 40. If additional solvent needs to be added during the impregnation stage 40, fresh solvent 46 can be added via suitable fluid conduits. An advantage of employing this recovery network is that it reduces the amount of waste solvent employed, and thus decreases the cost of the system.

The dried and impregnated ligno-cellulosic material is then formed into the composite particle product according to the formation stage 36, as described above.

In an alternate optional embodiment, the dried and impregnated ligno-cellulosic material can be mixed in a blending stage 28, shown in phantom, with either additional water-insoluble lignin 30, a conventional adhesive 32, or both in the blending stage 28, as described above.

The blending of the lignin impregnated ligno-cellulosic material and the lignin 30/adhesive 32 in the blending stage 28 allows the addition of further quantities of adhesive for binding the ligno-cellulosic material to form the particle product. The process lignin 30 blended with the water-insoluble lignin pregnated material forms additional bonds between the macromolecules of the lignin, as well as between the macromolecules of the ligno-cellulosic material. The addition of conventional adhesives 32 can be added to the blending stage 28 in the form of powder, concentrated aqueous solutions, either before, after or simultaneously with the water-insoluble process lignin 30.

With regard to the embodiment of FIG. 3, the system 52 impregnates the ligno-cellulosic material with water-insoluble lignin, rather than water-soluble lignin which is later converted when resident within the material to its original water-insoluble form. This eliminates the need to preprocess the lignin to convert it to a water-soluble form, thus conserving time and costs. Those of ordinary skill, however, will readily recognize that the present invention also contemplates impregnating the ligno-cellulosic material with water-soluble lignin either alone or in conjunction with water-insoluble lignin.

The practice of the present invention can produce stable composite particle products employing water-insoluble process lignin as a binder. The following non-restrictive examples exemplify these features.

EXAMPLES

Methodology for the Following Examples

The method of forming composite particle products described herein are illustrated by the following examples. This methodology corresponds to a methodology employed for laboratory use, and those of ordinary skill will readily recognize the adaptations that may be necessary to this methodology for use in existing particle product formation systems. In all the aforementioned examples, the air dried strands of White Pine have a thickness between 0.5–0.9 mm, a length between a 20–50 mm, a width between 3–8 mm, and a moisture content between 5–10%. The amount of white pine strands used totaled about 55 g of strands for each experiment.

The impregnation of the strands with a lignin solution were accomplished in a liter polythene vessel. About 400 ml of the lignin solution or another adhesive solution were added to the strands. Then the obtained mixture was pressed several times by an acrylic plastic bar, and the excess solution was removed. The quantity of adsorbed lignin or other adhesive substance was calculated by determining the change in the strand weight relative to the initial concentration of the adhesive solution. Thus, it was assumed that during impregnation the concentration of the adhesive solution remained constant.

Then the impregnated strands were dried in a dryer at 85–90° C. between 1.5–2.4 hours. The dryer had a rectangular bottom, having dimensions of 1 foot by 2 feet. In the process of drying the strands were agitated to achieve more uniform drying of the strands.

The strands were removed from the dryer and either alone, or in combination with powdered lignin, were placed into a die having a diameter of about 79.2 mm and a corresponding piston. The strands were preliminarily pressed without heating (at room temperature) at a pressure of about 80 kg/cm$^2$. The position of the piston was fixed and the press-form was placed in the dryer and heated there at a temperature between about 140–150° C. for between about 0.5–1.0 hours.

The die was then removed from the dryer and pressed again at the same pressure while hot. The position of the piston was fixed and the press-form was placed in the dryer and heated between about 160–170° C. for about 2 hours. Then the press-form was cooled, the formed mat (composite product) was removed, cut into appropriate sized segments, and the properties of the obtained material were analyzed by immersing the segments in water and determining the variations in segment thickness and the quantity of adsorbed water over time. The density of plate was also controlled. The internal bond of some of the samples was also tested.

The efficacy of the lignin adhesive was determined for different types of lignin; including kraft-lignin Indulin, lignin ALCELL®, and wheat lignin.

Those of ordinary skill will recognize that different wood types require different pressures to compress the wood, and preferably presses capable of achieving pressures of 10 kg/cm$^2$ and higher employed in accordance with the teachings of the present invention.

Example 1

In this example, the quality of the composite product produced from strands without lignin adhesive and strands impregnated with a 5% aqueous-ethanolic (1:1) lignin ALCELL® solution were compared. The quantity of lignin absorbed by the strands during the impregnation process and left on the surface of the strands was approximately 8 g. Both samples were pressed at 540 kg/cm$^2$, and the temperature of the preliminary heating was about 150° C., and the temperature of the final heating was about 160° C. The experimental data are set forth below in Table 1.

TABLE 1

Influence of lignin addition on composite properties.

| | Sample | Lignin ALCELL ® added | Density, kg/m$^3$ | Water absorption % | Thickness increase % |
|---|---|---|---|---|---|
| 1 | Without lignin | No | 1110 | Unlimited swelling and destruction of the sample | |
| 2 | With lignin | Yes, 12% of lignin to the weight of strands | 1180 | 1 h - 69.6<br>2 h - 87.6<br>24 h - 115.7 | 1 h - 56.6<br>2 h - 60.2<br>24 h - 79.1 |

The data set forth in Table 1 illustrates that the strands without added lignin are quickly destroyed when immersed in water. On the other hand, the strands impregnated with the water-insoluble lignin remained firm (strong), even after being immersed in water for 24 hours. There was noted a slight increase in density, due to the reactions between the wood and the lignin binder.

Example 2

In this example, the efficacy of glyoxal used as an additional adhesive binder, with and without the addition of water-insoluble lignin, are compared. All the strands were impregnated with glyoxal solutions of different concentration for between about 5–10-minutes. The excess solution was then removed and the strands were dried in a dryer and used to produce composite plates bound together with Indulin or lignin wheat. The pressing of the plates both before the preliminary and final heating stages were performed at about 80 kg/cm$^2$. The temperature of the preliminary heating stages was about 155° C., and the final heating stage was about 165° C. The experimental data are set forth below in Table 2.

TABLE 2

Influence of glyoxal and the type of process lignin on the properties of the composite product.

| | Type of lignin added | Quantity and type of additive to the raw material, weight % | Density, kg/m$^3$ | Water absorption, % | Thickness increase, % | Internal bond, psi |
|---|---|---|---|---|---|---|
| 1 | Without lignin | Glyoxal 3.3% | 700 | 3 min before loss of shape and destruction | | |
| 2 | Indulin | Glyoxal 3.3%, Lignin 15% | 860 | 1 h - 47.6<br>2 h - 52.4<br>24 h - 65.3 | 1 h - 10.6<br>2 h - 14.2<br>24 h - 19.1 | 24 |
| 3 | Wheat | Glyoxal 1.65%, Lignin 15% | 840 | 1 h - 38.5<br>2 h - 55.9<br>24 h - 166.5 | 1 h - 14.9<br>2 h - 22.0<br>24 h - 141.1 | 24 |
| 4 | Wheat | Glyoxal 1.65%, Lignin 25% | 810 | 1 h - 24.3<br>2 h - 34.1<br>24 h - 120.5 | 1 h - 5.9<br>2 h - 8.6<br>24 h - 54.6 | |

The data shown in Table 2 illustrates that the use of a glyoxal adhesive without the addition of water-insoluble process lignin does not produce a plate that remains stable in water (see run 1). On the other hand, the addition of the lignin stabilizes the plate when immersed in water (see runs 2–4). Even if the glyoxal content is reduced by 50% (e.g., 1.65% instead of 3.3%), the stability of the plate when immersed in water is significantly enhanced upon an increase in the addition of water-insoluble lignin content from 15 to 25% (runs 3 and 4).

Example 3

In this example, the efficacy of different polyacrylates (Rhoplex HA) used as adhesives was tested. This example used the same experimental method as in example 2. Rhoplex HA-8, Rhoplex HA-12, Rhoplex HA-16 were used in different runs. Powdered water-insoluble Kraft-lignin (Indulin AT) or lignin ALCELL® was added in particular runs.

TABLE 3

Influence of different lignin and different Rhoplex HA adhesives of the composite product.

| Type of | Quantity and type of additive to the raw | Water | Thickness | Internal |
|---|---|---|---|---|

| | lignin added | material, weight % | Density, kg/m$^3$ | absorption, % | increase, % | bond, psi |
|---|---|---|---|---|---|---|
| 1 | Indulin | Rhoplex HA-8<br>3.5<br>Lignin | 800 | 1 h - 112.1<br>2 h - 117.3<br>24 h - 139.3 | 1 h - 55.8<br>2 h - 57.8<br>24 h - 66.9 | 23 |
| 2 | Indulin | Rhoplex HA-12<br>3.3<br>Lignin<br>15 | 840 | 1 h - 97.0<br>2 h - 103.0<br>24 h - 114.9 | 1 h - 38.1<br>2 h - 40.1<br>24 h - 40.9 | — |
| 3 | Indulin | Rhoplex HA-16<br>3.3<br>Lignin<br>15 | 790 | 1 h - 91.2<br>2 h - 95.9<br>24 h - 112.8 | 1 h - 33.5<br>2 h - 36.1<br>24 h - 42.6 | 39 |
| 4 | ALCELL | Rhoplex HA-16<br>3.4<br>Lignin<br>15 | 800 | 1 h - 45.5<br>2 h - 56.1<br>24 h - 69.7 | 1 h - 12.5<br>2 h - 16.7<br>24 h - 28.7 | 70 |
| 5 | ALCELL | Rhoplex HA-16<br>1.7<br>Lignin<br>25 | 960 | — | — | 105 |
| 6 | ALCELL | Rhoplex HA-16<br>3.4<br>Lignin<br>8 | 883 | — | — | 27 |
| 7 | Without lignin | Rhoplex HA-16<br>3.3 | 670 | 1 h - 140.4<br>2 h - 147.9<br>24 h - 167.8 | 1 h - 52.9<br>2 h - 60.5<br>24 h - 77.1 | 6.0 |

The data set forth in Table 3 illustrates that the most effective crylate adhesive is Rhoplex HA-16, when compared with Rhoplex HA-12 Rhoplex HA-8. On the other hand, it should be emphasized that even the most effective adhesive, Rhoplex HA-16, if used alone (e.g., without lignin) shows results considerably worse than the least effective polyacrylate adhesive (e.g., rhoplex HA-8) when used with water-insoluble kraft-lignin Indulin. At the same the type of lignin used is important. For example lignin ACELL® was approximately 2 times more effective as an adhesive binder than kraft-lignin Indulin, both in terms of water resistance and in terms of stabilization of the composite thickness when immersed in water.

From the data in Table 3, it is apparent that the use of lignin with one of the conventional adhesives increases the internal bonding that occurs beyond that of water-insoluble lignin alone using a given quantity and type of lignin. The best results were obtained with ALCELL® lignin. This is understandable because this lignin has the highest reactivity of all the lignins investigated.

Example 4

In this example, the efficacy of FREEREZ™ 900 adhesive, when used with or without lignin was analyzed: This example used the same experimental method used in example 2, and the results are set forth in Table 4.

TABLE 4

Influence of lignin and FREEREZ ™ 900 addition on the properties of composite products.

| | Lignin addition | Quantity and type of additive to the raw material, weight % | Density, kg/m$^3$ | Water absorption % | Thickness increase, % | Internal bond, psi |
|---|---|---|---|---|---|---|
| 1 | Without lignin | FREEREZ ™ 900<br>3.3 | 655 | 1 h - 160.4<br>2 h - 179.2<br>24 h - 203.2 | 1 h - 50.3<br>2 h - 54.0<br>24 h - 66.3 | 9.0 |
| 2 | Lignin ALCELL ® | FREEREZ ™ 900<br>3.3<br>Lignin<br>~15 | 820 | 1 h - 38.0<br>2 h - 58.1<br>24 h - 77.1 | 1 h - 9.3<br>2 h - 23.3<br>24 h - 38.0 | 74.0 |

The data shown in Table 4 illustrates the efficacy of FREEREZ™ 900 when used with and without lignin. Without lignin, the addition of this conventional adhesive does not minimize either the degree of water absorption or the degree of composite swelling. When used with water-insoluble ALCELL® lignin, the water absorption properties are significantly decreased.

Comparison of the data in Tables 2, 3, and 4 illustrates the active role that the added water-insoluble lignin plays in the bonding reaction because the internal bond formed in the samples containing lignin is substantially higher than with simple adhesive, e.g., glyoxal, alone.

Example 5

Figure 6:
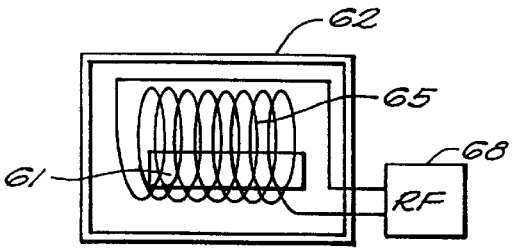
FIG. 6 is a cross-sectional view of a high frequency electromagnetic generating system suitable for drying ligno-cellulosic material.

In this example 60 g of the ligno-cellulosic material was heated using an electromagnetic field generated by a suitable RF generator, such as that illustrated in FIG. 6. For this example, White Pine strands were impregnated with approximately 5% aqueous-ethanolic (1:1) lignin ALCELL® solution and dried in a dryer at 90° C. The dried pine was then mixed with 10 g of fine powdered lignin ALCELL®, placed in a wooden form press with an inner diameter of 84 mm, preliminarily pressed at 250 kg/cm$^2$, and exposed to a high frequency electromagnetic field for about 3 minutes. The heated pine was again compressed, and the pressure was maintained at the same level as during the preliminary pressing stages. The properties of the final composite product are set forth below in Table 5.

TABLE 5

Properties of White Pine strands impregnated with lignin solution.

| Type of lignin added | Quantity of additive* to the raw material, weight % | Density kg/m$^3$ | Water absorption, % | Thickness increase, % |
|---|---|---|---|---|
| ALCELL ® | ~10 + 20 | 1250 | 1 h - 6.6<br>2 h - 10.7<br>24 h - 15.3 | 1 h - 4.8<br>2 h - 6.9<br>24 h - 10.5 |

Note: ~10% delivered during the strands impregnation and 20% was added as fine powder.

The data set forth in Table 5 illustrate that the strands impregnated with water-insoluble lignin and mixed with powdered process lignin, which mixture is then exposed to an electromagnetic field, heated, and then compressed to form a composite product, exhibits relatively high density and is resistant to water.

Special attention should be given to the efficacy of water-insoluble process lignin. Analysis of the data of Tables 2 through 4 show that the composite products bound together with only conventional adhesive (e.g., without lignin) and when subjected to the processing conditions does not produce a composite product having a sufficiently high density (see e.g., run 1, Table 2; run 5, Table 3, and run 1, Table 4.) In all these examples, the density of the composite product does not exceed 700 kg/m$^3$. These results indicate that the bond-forming ability of the conventional adhesive is insufficient to form a suitable, stable composite product, absent the use of additional water-insoluble lignin according to the teachings of the present invention.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. Method for forming a particleboard product having as a constituent component a ligno-cellulosic material, comprising the steps of providing a milled ligno-cellulosic material having a lignin and a cellulose component, adding water-insoluble lignin to said milled ligno-cellulosic material to form a lignin bonding mixture without removing the lignin component from the ligno-cellulosic material, said water-insoluble lignin functioning as the primary adhesive for the product, and forming the particleboard product from said lignin bonding mixture.

2. Method in accordance with claim 1, wherein said step of forming comprises the steps of compressing said lignin bonding mixture, and heating said lignin bonding mixture to a selected elevated temperature and for a time sufficient to promote bonding between said water-insoluble lignin and said ligno-cellulosic material, wherein said water-insoluble lignin adheres said milled ligno-cellulosic material together to form a stable particleboard product.

3. Method in accordance with claim 1, wherein said forming step further comprises the step of subjecting the lignin bonding mixture to one of an elevated temperature and an elevated pressure to promote bonding between said water-insoluble lignin and said ligno-cellulosic material components of said mixture to form said composite particle product.

4. Method in accordance with claim 1, wherein said step of forming further comprises the step of heating said lignin bonding mixture for a time sufficient to promote diffusion of said lignin into the cell walls of said ligno-cellulosic material.

5. Method in accordance with claim 1, further comprising the step of heating said lignin bonding mixture to a selected elevated temperature to promote one of bonding and cross-linking between said ligno-cellulosic material and said water-insoluble lignin.

6. Method in accordance with claim 1, further comprising the step of heating said lignin bonding mixture with electromagnetic energy having a frequency in the range between about 2 MHz and about 2000 MHz.

7. Method in accordance with claim 5, wherein the step of heating comprises subjecting said lignin bonding mixture to an elevated temperature between about 100° C. and about 240° C.

8. Method in accordance with claim 5, wherein the step of heating includes subjecting said lignin bonding mixture to an elevated temperature for a time between about 1 second and about 60 seconds per millimeter of thickness of said particle product thickness.

9. Method in accordance with claim 1, wherein said step of providing said water-insoluble lignin further comprises the step of providing low molecular mass lignin having a mass less than about 3,000 Daltons.

10. Method in accordance with claim 1, wherein said step of providing said lignin further comprises the step of providing low molecular mass lignin having a mass less than or equal to about 10,000 Daltons.

11. Method in accordance with claim 1, wherein said step of providing lignin further comprises the step of providing highly reactive lignin having reactive functional groups selected from the group consisting of phenolic groups, alcohol groups, carbonyl groups, carboxyl groups, and double bonded propyl chains.

12. Method in accordance with claim 1, wherein said step of adding water-insoluble lignin further comprises the step of selecting highly reactive lignin having a molecular mass less than about 5,000 Daltons.

13. Method in accordance with claim 1, wherein said step of providing lignin further comprises the step of providing a selected quantity of lignin in a range between about 2% and about 40% by weight of said ligno-cellulosic material.

14. Method in accordance with claim 1, further comprising the step of, prior to said step of adding, drying said ligno-cellulosic material to have a selected moisture content of about 30% or less.

15. Method in accordance with claim 1, further comprising the step of, prior to said step of adding, drying said ligno-cellulosic material to a utility level of dryness.

16. Method in accordance with claim 1, further comprising adding an adhesive binder to said ligno-cellulosic material.

17. Method in accordance with claim 16, wherein said step of adding an adhesive binder further comprises the step of selecting said binder from one of furfural, formaldehyde, glyoxal, phenols, urea-formaldehyde resins, phenol-formaldehyde resins, melamino-formaldehyde resins, polyisocyanates, polyamides, polyamines, polyacids, natural and synthetic latexes, siliceous organic substances and mixtures and derivatives thereof.

18. Method in accordance with claim 1, further comprising the step of promoting the reaction between said water-insoluble lignin and said ligno-cellulosic material.

19. Method in accordance with claim 18, wherein said step of promoting comprises the step of adding a compound selected from the group consisting of furfural, formaldehyde, glyoxal, urea-formaldehyde resins, phenol-formaldehyde resins, melamino-formaldehyde resins, phenols, amine phenols, polyacids, polyisocyanates, polyamides, natural and synthetic latexes, organosilanes, and mixtures and derivatives thereof.

20. Method in accordance with claim 1, further comprising the step of dissolving said water-insoluble lignin in a solvent.

21. Method in accordance with claim 1, wherein said step of providing lignin comprises the steps of employing only water-insoluble lignin as a binder, and selecting a quantity of said lignin in a range between about 2% and about 40% by weight of said ligno-cellulosic material.

22. Method for forming a particleboard product having as a constituent component a milled ligno-cellulosic material, comprising the steps of providing said milled ligno-cellulosic material having a lignin and a cellulose component, providing water-insoluble lignin for functioning as the primary adhesive for the particleboard product, impregnating said ligno-cellulosic material with said water-insoluble lignin, and forming the particleboard product from said impregnated ligno-cellulosic material.

23. Method in accordance with claim 22, wherein said step of providing water-insoluble lignin comprises the step of dissolving said water-insoluble lignin in an organic solvent.

24. Method in accordance with claim 22, wherein said step of providing water-insoluble lignin comprises the step of dissolving said water-insoluble lignin in a solution of alcohol and water.

25. Method in accordance with claim 22, further comprising the step of, after said step of impregnating, evaporating said solvent component of said solution.

26. Method in accordance with claim 25, further comprising the step of, after said step of evaporating, condensing said evaporated solvent.

27. Method in accordance with claim 26, further comprising the step of recycling said condensed solvent.

28. Method in accordance with claim 22, further comprising the step of, prior to said step of impregnating, drying said ligno-cellulosic material.

29. Method in accordance with claim 22, further comprising the step of, prior to said step of impregnating, drying said ligno-cellulosic material to a moisture content of about 30% or less.

30. Method in accordance with claim 22, wherein said step of forming comprises the step of heating said impregnated ligno-cellulosic material to a temperature in the range between about 100° C. and about 240° C.

31. Method in accordance with claim 22, wherein said step of forming further comprises the step of subjecting said impregnated ligno-cellulosic material to one of an elevated temperature and an elevated pressure to promote bonding between said lignin and said ligno-cellulosic material.

32. Method in accordance with claim 22, wherein said step of forming comprises the steps of heating and compressing said impregnated ligno-cellulosic material at a temperature, time and pressure sufficient to allow bonding between said lignin and said ligno-cellulosic material to form the composite particle product.

33. Method in accordance with claim 22, further comprising the step of heating said lignin bonding mixture with electromagnetic energy to a selected elevated temperature.

34. Method in accordance with claim 33, wherein the step of heating further comprises the step of forming free radicals to promote chemical bonding between adjacent molecules of said ligno-cellulosic material and said lignin, and between adjacent molecules of said lignin.

35. Method in accordance with claim 22, further comprising the step of providing lignin having a molecular mass of less than about 10,000 Daltons.

36. Method in accordance with claim 22, wherein said step of providing water-insoluble lignin comprises the step of providing lignin having a molecular mass of less than about 3,000 Daltons.

37. Method in accordance with claim 22, wherein said step of adding water-insoluble lignin further comprises the step of selecting highly reactive lignin having a molecular mass of less than about 5,000 Daltons.

38. Method in accordance with claim 22, further comprising the step of promoting the reaction between said water-insoluble lignin and said ligno-cellulosic material.

39. Method in accordance with claim 38, wherein said step of promoting comprises the step of adding a compound selected from the group consisting of furfural, formaldehyde, glyoxal, urea-formaldehyde resins, phenol-formaldehyde resins, melamino-formaldehyde resins, phenols, amine phenols, polyacids, polyisocyanates, polyamides, natural and synthetic latexes, organosilanes, and mixtures and derivatives thereof.

40. Method in accordance with claim 22, further comprising the step of, after said step of impregnating, adding additional water-insoluble lignin to an outer surface of said impregnated ligno-cellulosic material.

41. Method in accordance with claim 40, wherein said step of forming further comprises the step of heating and pressing the secondary supply of lignin and said impregnated ligno-cellulosic material for a time sufficient to allow bonding therebetween to form the composite particle product.

42. Method in accordance with claim 23, further comprising adding said water-insoluble lignin to said solvent in an amount in a range between about 0.1% and about 70%.

43. Method in accordance with claim 22, further comprising the step of adding an adhesive binder to said impregnated ligno-cellulosic material to further bind the material together.

44. Method for forming a particleboard product having as a constituent component a ligno-cellulosic material, comprising the steps of providing woodchips or strands having a lignin component and a cellulose component, adding water-insoluble lignin to said woodchips or strands to form a lignin bonding mixture without removing the lignin component from the woodchips or strands prior to the addition of the water-insoluble lignin, said water-insoluble lignin functioning as the primary adhesive for the particleboard product, and compressing and heating the lignin bonding mixture to a selected elevated temperature and for a time sufficient for the water-insoluble lignin to adhere the woodchips or strands together to form the particleboard product.

* * * * *